US005875552A

United States Patent [19]

Chen

[11] Patent Number: 5,875,552

[45] Date of Patent: Mar. 2, 1999

[54] MULTISTAGE POCKET-KNIFE

[75] Inventor: Shun-fu Chen, Taipei, Taiwan

[73] Assignee: Chia Yi Enterprise Co., Ltd., Taipai Hsien, Taiwan

[21] Appl. No.: 779,649

[22] Filed: Jan. 15, 1997

[51] Int. Cl.[6] ..... B26B 1/04

[52] U.S. Cl. ..... 30/161; 30/160

[58] Field of Search ..... 30/158, 159, 160, 30/161

[56] References Cited

U.S. PATENT DOCUMENTS

| | | | |
|---|---|---|---|
| 727,724 | 5/1903 | Weil | 30/161 |
| 4,148,140 | 4/1979 | Lile | 30/161 |
| 4,347,665 | 9/1982 | Glesser | 30/161 |
| 4,604,803 | 8/1986 | Sawby | 30/161 |
| 5,092,045 | 3/1992 | Boyd, Jr. et al. | 30/161 |
| 5,425,175 | 6/1995 | Rogers | 30/161 |

FOREIGN PATENT DOCUMENTS

| | | | |
|---|---|---|---|
| 715262 | 8/1965 | Canada | 30/161 |
| 19852 | 11/1891 | United Kingdom | 30/160 |

*Primary Examiner*—Hwei-Siu Payer

*Attorney, Agent, or Firm*—Beveridge, DeGrandi Weilacher & Young LLP

[57] ABSTRACT

Disclosed is a multistage pocket-knife being characterized in a pair of spring-supported balls rotatably received in ball holes formed on two side members of a knife handle and through holes formed on two lining members positioned adjacent to the side members. A blade of the knife is formed with several round holes near a rear edge thereof. Whereby, when the blade is in a folded position in the handle, the pair of balls extend a part thereof into one of the round holes on the blade and thereby firmly hold the blade in place without easily turning out of the handle even when the knife collides with something or falls accidentally. And, when the blade is in a process of extending or folding, the pair of balls engage into other round holes sequentially, permitting the blade to be safely extended or folded in more than one stage.

4 Claims, 5 Drawing Sheets

MULTISTAGE POCKET-KNIFE

FIELD OF THE INVENTION

The present invention relates to a pocket-knife, and more particularly to a pocket-knife of which a blade can be extended or folded relative to a handle of the pocket-knife in multiple stages.

BACKGROUND OF THE INVENTION

There are many differently structured pocket-knives. For example, U.S. Pat. No. 4,347,665 to Glesser discloses a pocket-knife having a body including a pair of side portions separated by a spacer so as to define a storage cavity for a knife blade. The blade is pivotally carried by its end from a selected end of the body between a stored position and an open or operative position. A releasable lock mechanism operably carried on the body for retaining the blade in its open position. The blade is provided with a cutting edge along an underside and a cutting edge of shorter length is provided along the top side and a finger depression is formed on the blade adjacent to an enlarged portion for grasping by the thumb of the user for urging the blade from its closed position into its open or operative position.

U.S. Pat. No. 4,741,106 to Yamagishi discloses a folding pocket-knife substantially including a handle, a blade retaining lever and a blade. The blade is pivotally held in the handle wherein the engagement between a holding lever and the base of the blade, which keeps the blade out of the handle, is released by depressing the press area of the lever. The press area of the lever is covered with soft and pliable material that can be moved downward together with the press area so that the disengagement between the retaining lever and the blade can be made without pain to the finger. The whole body of the handle is covered with the soft and pliable material, but the handle may be formed with hard material except the portion over the press area so that this portion is covered with the soft and pliable material.

U.S. Pat. No. 4,985,998 to Howard discloses a knife having a foldable blade includes a locking bar which holds the blade in an open position. A release lever is provided on the side of the handle for releasing the locking bar and allowing the blade to be moved to a closed position. The release lever has a laterally exposed portion which is flush with the outer surface of a bolster of the knife and a projection which extends into the recess which receives the blade when the knife is closed. The projection engages the bottom surface of the locking bar and urges it upward when the laterally exposed portion is depressed.

The above-mentioned conventional pocket-knives have different control mechanisms to extend or fold their blades. However, all these conventional pocket-knives do not have any design to allow the blade thereof to be extended or folded in a smooth but stepped manner. In the event the blade is too loosely held in the handle, a user might be accidently injured when the blade is pushed to extend with a too strong force. On the other hand, in the event the blade is too tightly held in the handle, the user will have to exert a strong force to extend the blade even with two hands. When the blade is not extended or folded in a stepped manner, the pocket-knife tends to more easily injure the user's hand. It is therefore desirable to eliminate this drawback existed in the conventional pocket-knives.

SUMMARY OF THE INVENTION

A primary object of the present invention is to provide a multistage pocket-knife including a blade pivotally held between two side members forming a handle of the knife, wherein a pair of balls supported by springs are provided to inner surfaces of the two side members of the handle near a pivot of the blade, corresponding to several round through holes formed near a rear end of the blade. Whereby, when the blade is in a folded position, the spring-supported balls just fall into a first round through hole on the blade and being firmly pressed against the round through hole by the springs, preventing the blade from easily moving out of the handle even when the knife collides with something or falls down from some higher position. On the other hand, when the blade is in the process of extending or folding, the balls fall into other round through holes sequentially, so that the blade is extended or folded in different stages to ensure a safe extending or folding of the blade to a desired position.

Another object of the present invention is to provide a multistage pocket-knife wherein two lining members are separately positioned between the blade and the two side members of the knife handle. One of the lining members has an inclinedly extended leaf spring serving as a locking means for operation by a user to control the extending or folding of the blade relative to the handle. The two lining members are heat treated and are therefore, capable of reinforcing portions of the pocket-knife at where the blade is frequently pivotally turned relative to the handle, preventing the knife from being early damaged due to such frequent turning of blade.

BRIEF DESCRIPTION OF THE DRAWINGS

The present invention can be best understood by referring to the following detailed description of the preferred embodiment and the accompanying drawings, wherein.

DETAILED DESCRIPTION OF THE PREFERRED EMBODIMENT

Figure 1:
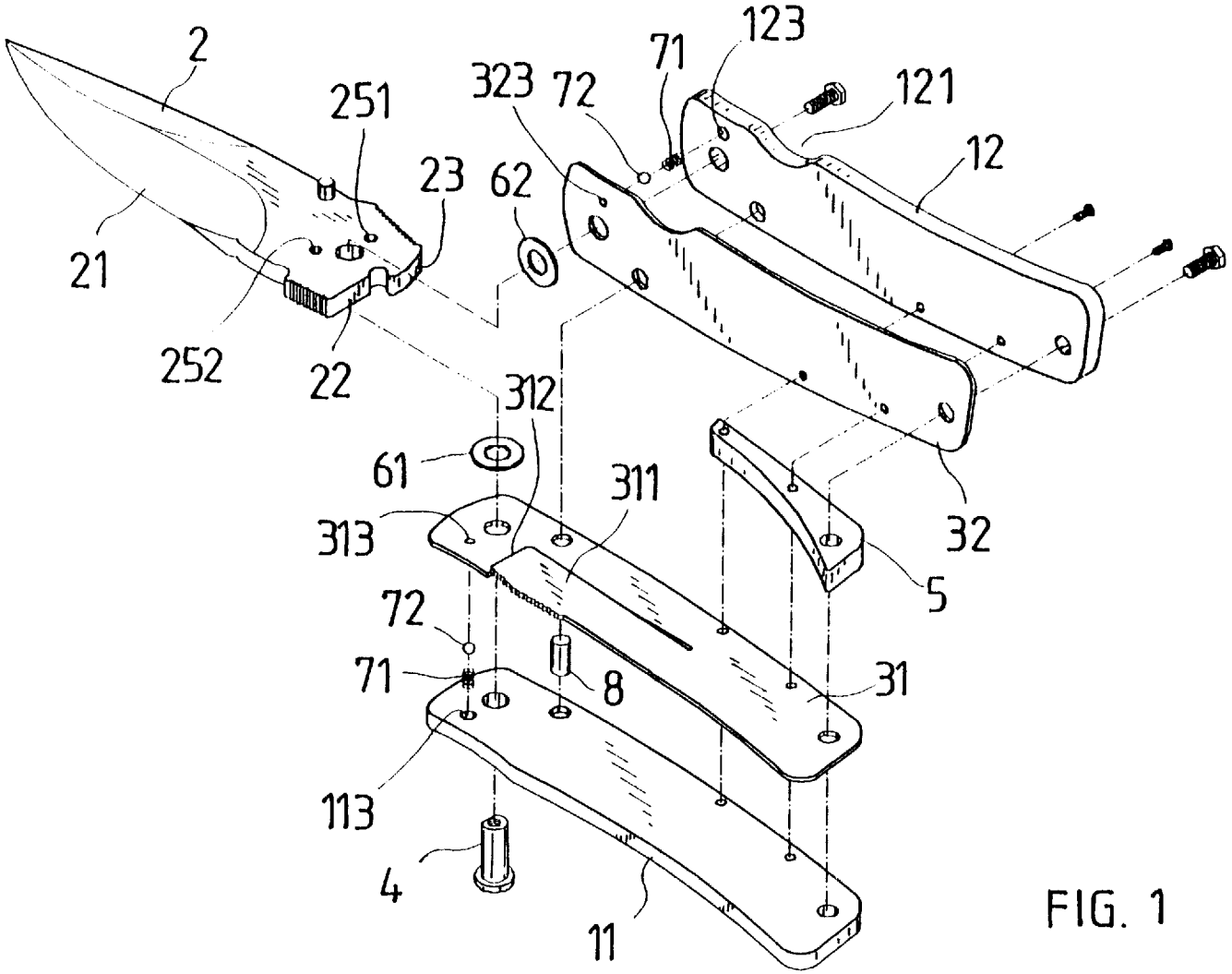
FIG. 1 is an exploded perspective of the pocket-knife of the present invention.
Figure 3:
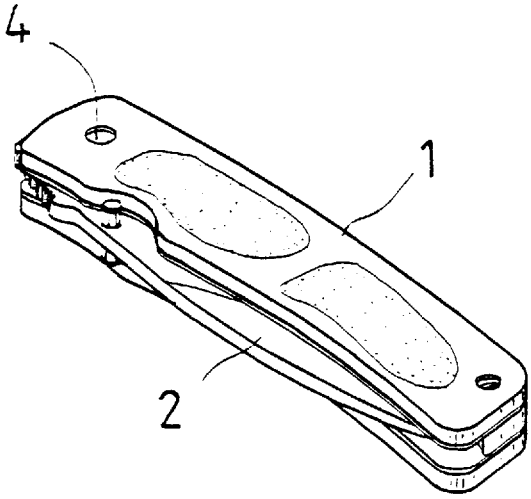
FIG. 3 is an assembled perspective of the pocket-knife of FIG. 1 with the blade in a completely folded position.
Figure 2:
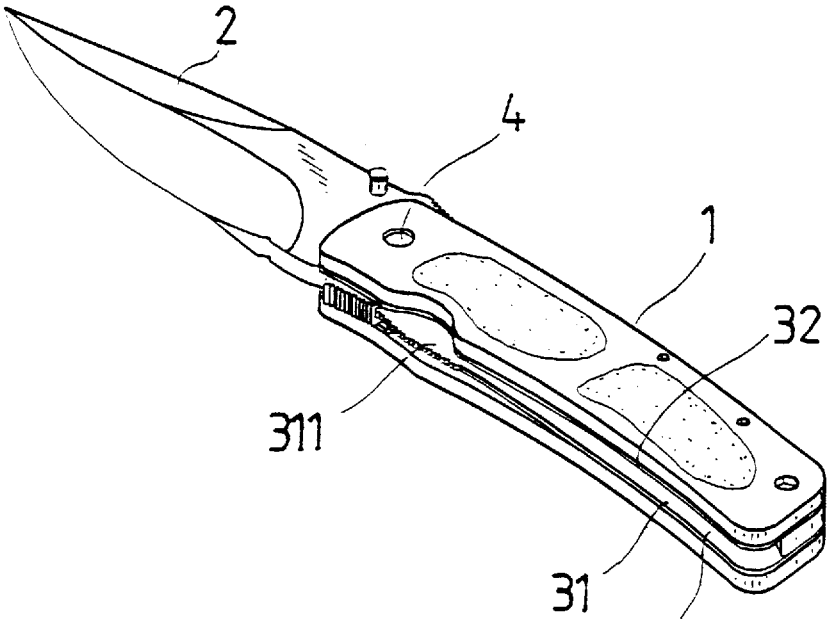
FIG. 2 is an assembled perspective of the pocket-knife of FIG. 1 with the blade in a fully extended position.

Please refer to FIG. 1. The present invention relates to a multistage pocket-knife which mainly includes a handle 1 consisting of a first side member 11 and a second side member 12, and a blade 2 pivotally connected to a front end of the handle 1 by means of a pivotal shaft 4, so that the blade 2 can be pivotally turned relative to the handle 1 between an extended operation position as shown in FIG. 2 and a folded position as shown in FIG. 3. When the blade 2 is in the folded position, a cutting edge 21 thereof is received in a cavity 13 formed in the handle 1 by means of a tie member 5 positioned between the two side members 11, 12.

Figure 6:
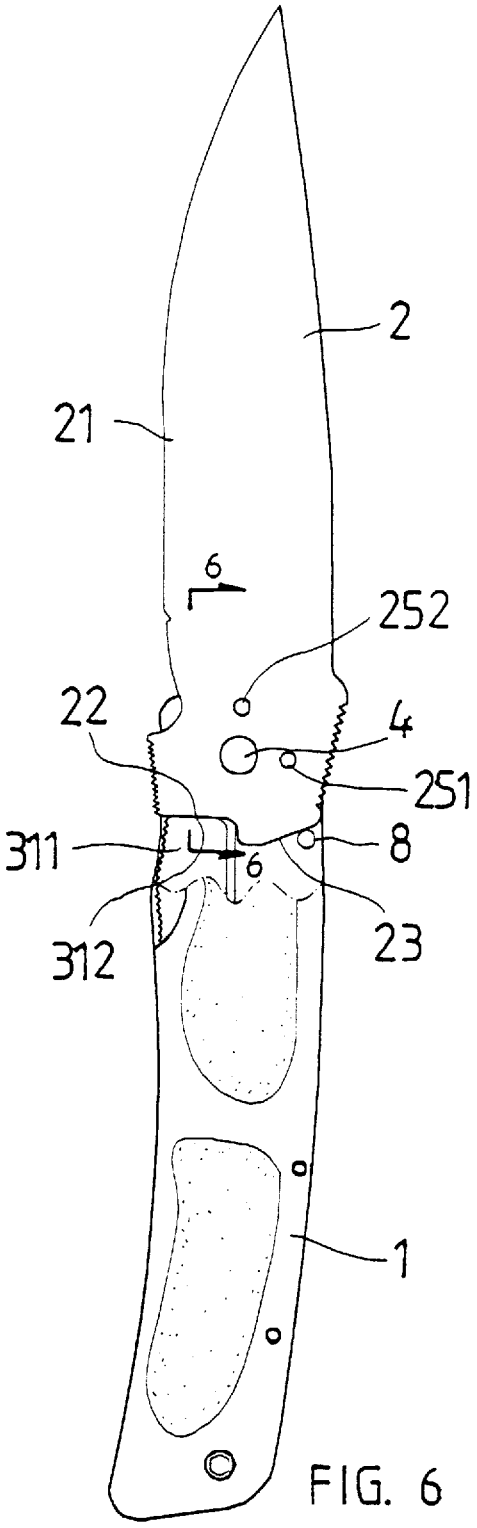
FIG. 6 is a plan view of the present invention with the blade in a fully extended position for use.
Figure 6A:
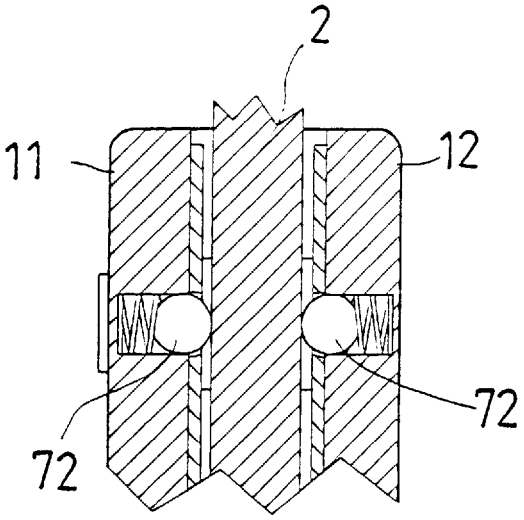
FIG. 6A is an enlarged, fragmentary, sectional view taken on line 6—6 of FIG. 6.

A first and a second lining members 31, 32 are positioned between the blade 2 and the first and the second side members 11, 12, respectively. A first and a second washers 61, 62 are positioned between the blade 2 and the first and the second lining members 31, 32, respectively, for the pivotal shaft 4 to extend through and pivotally connect the blade 2, the side members 11, 12, and the lining members 31, 32 together. As shown in FIG. 1, the first lining member 31 has a part forming an inclinedly extended leaf spring 311 to serve as a locking means. A user controls the extending and folding of the blade 2 by operating the leaf spring 311. When the blade 2 is extended to an operation position, as shown in FIG. 6, a front edge 312 of the leaf spring 311 shall abut against a first rear edge 22 of the blade 2, holding the blade 2 in the operation position. A stopper 8 extends through a point of the handle 1 near an inner edge thereof, such that it abuts against a second rear edge 23 of the blade 2 when the blade 2 is extended to the operation position, and together with the leaf spring 311 hold the extended blade 2 in place without shifting further.

Figure 4:
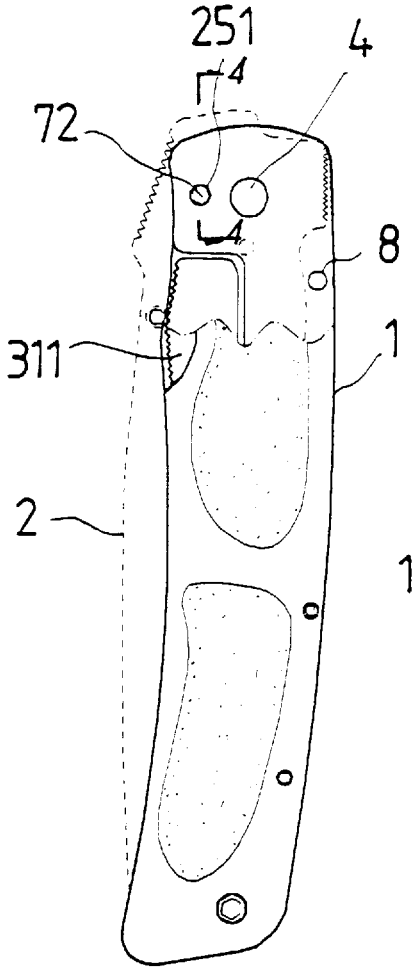
FIG. 4 is a plan view of the present invention with the blade in a completely folded position.

The second side member 12 has a dent 121 formed at its outer edge to expose a part of the leaf spring 311. When a force is applied on the exposed part of the leaf spring 311 to depress the same, the leaf spring 311 shall no longer abut against the first rear edge 22 of the blade 2, allowing the blade 2 to be turned about the pivotal shaft 4 so that the cutting edge 21 thereof is received in the handle 1, as shown in FIG. 4.

Figure 4A:
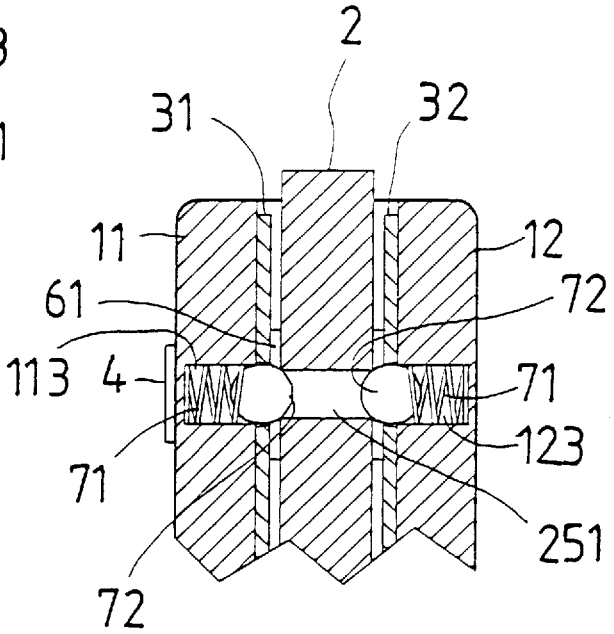
FIG. 4A is an enlarged, fragmentary, sectional view taken on line 4—4 of FIG. 4.

A pair of balls 72 supported on springs 71 are disposed in two ball holes 113, 123 formed on two inner surfaces of the first and the second side members 11, 12, respectively. The first and the second lining members 31, 32 are formed with through holes 313, 323, respectively, to correspond to the ball holes 113, 123, so as to retain the balls 72 in place, as shown in FIG. 4A. What is to be noted is the through holes 313 and 323 have a diameter gradually expanded toward an inner end thereof, so that the balls 72 are allowed to smoothly rotate inside the ball holes 113, 123 and the through holes 313, 323.

When the blade 2 is folded, portions of the balls 72 projecting from the through holes 313, 323 of the lining members 31, 32 fitly fall into two ends of a first round hole 251 formed near a pivotal point on the blade 2 and firmly clamp the blade 2 between them, providing an additional force to keep the folded blade 2 in place. Whereby, the folded blade 2 will not easily become loose and be turned out of the handle 1 even when it collides with something or falls accidently. This is the first purpose to provide the balls 72.

Figure 5A:
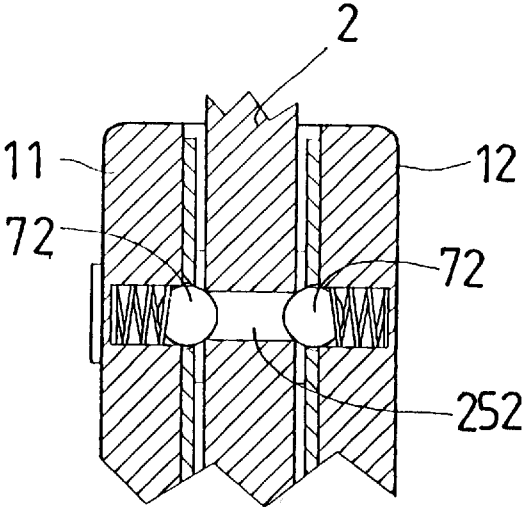
FIG. 5A is an enlarged, fragmentary, sectional view taken on line 5—5 of FIG. 5.
Figure 5:
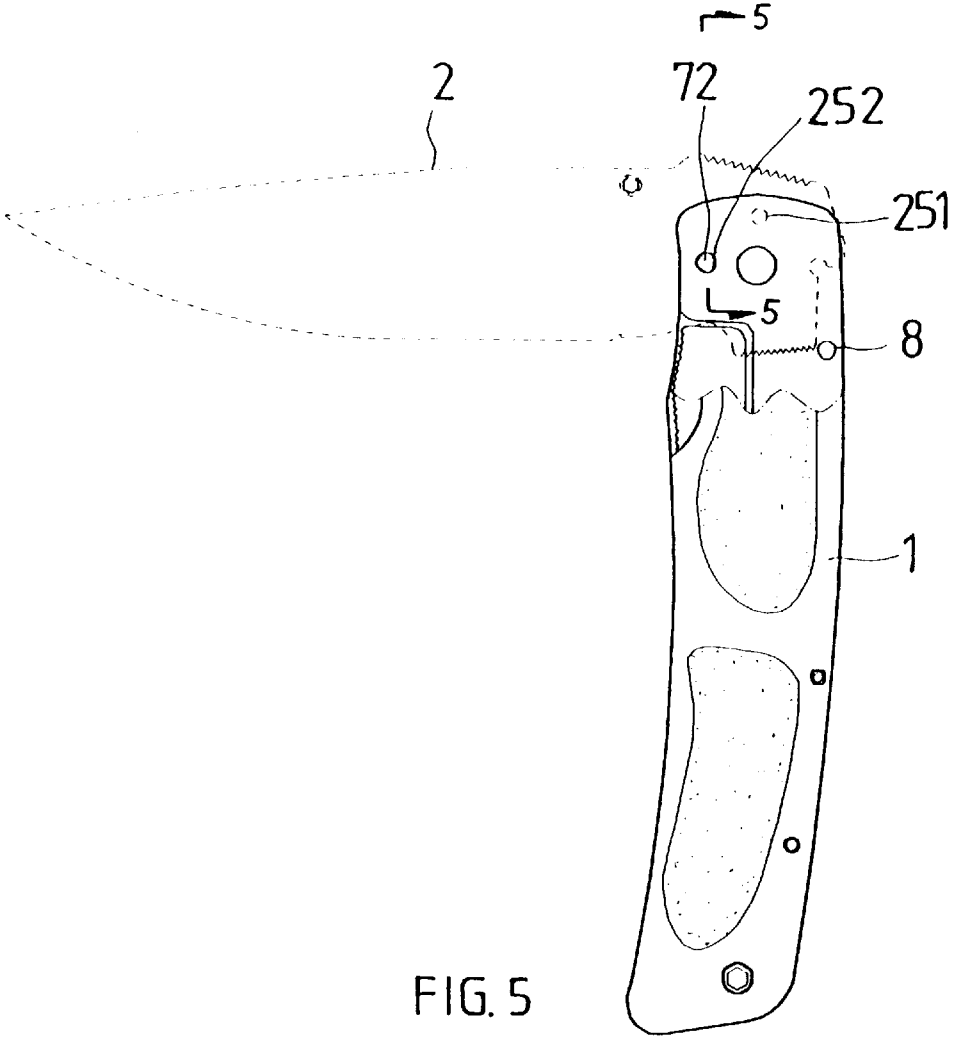
FIG. 5 is a plan view of the present invention with the blade in a partially extended position.

On the other hand, when the blade 2 is in the process of being extended or folded as shown in FIG. 5, the portions of the balls 72 projecting from the through holes 313, 323 of the lining members 31, 32 shall fitly fall into two ends of a second round hole 252 similarly formed near the pivotal point on the blade 2 and firmly clamp the blade 2 between them, providing an additional force to temporarily stop the blade 2 from further moving. Accidents such as being cut by the quickly extended or folded blade 2 due to improper force exerted on the blade 2 can therefore be avoided. The user may safely extend or fold the blade 2 relative to the handle 1. This is another purpose to provide the balls 72.

In the drawings, only a first and a second round holes 251 and 252 are illustrated. However, additional round holes can be provided around the pivotal point of the blade 2 on the same circumference according to the actual need, so that the blade 2 can be extended or folded in a multistage manner.

The pocket-knife of the present invention is also different from the conventional ones in the provision of the second lining member 32. The second lining member 32 not only provides the through hole 323 to locate one of the balls 72 in place, but also strengthens the whole structure of the knife. The side members 1 1, 12 tend to become worn or damaged at where the pivotal shaft 4 passing through due to frequent frictional contact with the turned blade 2. However, since the two lining members 31, 32 are heat treated to have enhanced structural strength, the above-mentioned wearing or damage of the side members 11, 12 due to long period of turning of the blade 2 relative to them can be minimized.

With the above arrangements, the multistage pocket-knife of the present invention can be used safely and has a largely improved structural strength than the conventional pocket-knives and is therefore practical and economical for use.

What is claimed is:

1. A multistage pocket-knife, comprising:

a handle including a first and a second side members oppositely facing each other and being separated apart from each other by a tie member disposed between them, defining a cavity therebetween;

a blade pivotally connected to said handle by means of a pivotal shaft, so that said blade is allowed to be pivotally turned relative to said handle between a folded position at which said blade is received in said cavity between said two side members and an operation position at which said blade is extended for use; and a locking means disposed in said handle to lock said blade in place when said blade is extended to said operation position, and said locked blade being allowed to release from said locking means and be folded in said handle when said locking means is depressed;

said multistage pocket-knife being characterized in that said first and said second side members have two ball holes formed at their inner surfaces to receive two spring-supported balls therein, that a first and a second lining members are disposed between said blade and said first and said second side members, respectively, to together with said first and said second side members retain said balls in said ball holes while allow said balls to smoothly rotate in the ball holes with portions of said balls projecting from said lining members, and that at least a first and a second round holes are formed on said blade near said pivotal shaft, such that when said blade is in said folded position, said portions of said spring-supported balls projecting from said lining members engage into said first round hole, and when said blade is in a process of being extended or folded, said portions of said spring-supported balls projecting from said lining members engage into said second or any additional round hole on said blade, permitting said blade to be extended or folded in a multistage manner.

2. A multistage pocket-knife as claimed in claim 1, wherein said locking means is an inclinedly extended leaf spring included in said first lining member, said leaf spring having a front edge which abuts against a first rear edge of said blade when said blade is extended to said operation position and holds said extended blade in place; and wherein said second side member has a dent formed at an outer edge thereof to expose a part of said leaf spring, whereby when said exposed part of said leaf spring is depressed, said extended blade is released from said front edge of said leaf spring and can be pivotally turned about said pivotal shaft to be received in said cavity of said handle.

3. A multistage pocket-knife as claimed in claim 2, wherein said first and said second side members have a stopper extending through an inner edge thereof, whereby when said blade is turned to said operation position, said stopper abutting against a second rear edge of said blade to together with said leaf spring hold said extended blade in place without further moving.

4. A multistage pocket-knife as claimed claim 1, further comprises through holes on said first and said second lining members have a diameter gradually expanded toward an inner end thereof so that said balls are allowed to smoothly rotate in said through holes while they are retained therein.

* * * * *